US010773181B2

(12) United States Patent
Pérez Schmidt et al.

(10) Patent No.: US 10,773,181 B2
(45) Date of Patent: Sep. 15, 2020

(54) PIÑATA OF REDUCED VOLUME TO FACILITATE THE TRANSPORT THEREOF

(71) Applicant: Sociedad de Inversiones Vértice Limitada, Las Condes, Santiago (CL)

(72) Inventors: Benjamín Pérez Schmidt, Santiago (CL); Inges Bizama Toledo, Santiago (CL); Paulina Hoffmann Rencoret, Santiago (CL); Florencia Rodríguez Errázuriz, Santiago (CL)

(73) Assignee: SOCIEDAD DE INVERSIONES VÉRTICE LIMITADA, Las Condes, Santiago (CL)

( * ) Notice: Subject to any disclaimer, the term of this patent is extended or adjusted under 35 U.S.C. 154(b) by 0 days.

(21) Appl. No.: 16/254,276

(22) Filed: Jan. 22, 2019

(65) Prior Publication Data

US 2020/0206650 A1 Jul. 2, 2020

(30) Foreign Application Priority Data

Dec. 27, 2018 (CL) ..... 3818-2018

(51) Int. Cl.
*A63H 33/00* (2006.01)
*A63H 37/00* (2006.01)
*A63F 9/00* (2006.01)

(52) U.S. Cl.
CPC ..... *A63H 37/00* (2013.01); *A63F 2009/0084* (2013.01)

(58) Field of Classification Search
CPC ..... A63H 37/00; A63H 2027/1016; A63H 2027/1091; A63F 2009/0083; A63F 2009/0084; A63F 2009/0086
USPC ..... 446/5, 75, 76, 79, 220, 221, 222, 224
See application file for complete search history.

(56) References Cited

U.S. PATENT DOCUMENTS

| | | | | | |
|---|---|---|---|---|---|
| 4,092,798 | A | | 6/1978 | Oquita | |
| 4,167,078 | A | * | 9/1979 | Oquita | A63H 37/00 446/5 |
| 4,932,915 | A | * | 6/1990 | Boris | A63H 27/10 446/220 |
| 5,254,026 | A | * | 10/1993 | Kaiser | A63H 27/10 206/522 |
| 5,263,889 | A | * | 11/1993 | Ledonne | A63H 33/00 206/526 |
| 5,797,783 | A | * | 8/1998 | Harris | A63H 27/10 40/124.05 |
| 6,048,591 | A | * | 4/2000 | Zwiebel | A47G 33/08 428/12 |

(Continued)

*Primary Examiner* — Joseph B Baldori
(74) *Attorney, Agent, or Firm* — Procopio, Cory, Hargreaves & Savitch LLP

(57) ABSTRACT

The present invention refers to piñatas and other container devices that store a volume of candies, gifts and/or prizes that are dispensed when the container device is opened. More particularly, the present invention provides a piñata of reduced volume to facilitate the transport thereof which is characterized in that comprises: an inflatable cavity; a receptacle of objects joined to said inflatable cavity, said receptacle of objects that has an aperture; sealing means of said inflatable cavity; and means for opening and closing said aperture of said receptacle of objects.
Additionally, the piñata which is subject of the present invention has the advantage of being esthetically appealing to a user.

9 Claims, 2 Drawing Sheets

(56) References Cited

U.S. PATENT DOCUMENTS

| | | | | |
|---|---|---|---|---|
| 6,318,013 | B1 * | 11/2001 | Cope | A47F 3/14 40/214 |
| 6,390,880 | B1 * | 5/2002 | Almazan | A47G 33/00 206/457 |
| D536,745 | S * | 2/2007 | Barton | D21/440 |
| 7,611,396 | B2 * | 11/2009 | Schnuckle | A63H 27/10 348/744 |
| 7,708,616 | B2 * | 5/2010 | Phillips | A63H 27/10 446/220 |
| 8,715,027 | B2 | 5/2014 | Limin et al. | |
| 2002/0081042 | A1 * | 6/2002 | Bohnsack | A45C 3/00 383/10 |
| 2007/0037472 | A1 * | 2/2007 | Greenwald | A63H 27/10 446/220 |
| 2007/0249259 | A1 * | 10/2007 | Pham | A63H 5/00 446/224 |
| 2015/0213742 | A1 * | 7/2015 | Chapman-Rickman | A63H 27/10 446/221 |

* cited by examiner

PIÑATA OF REDUCED VOLUME TO FACILITATE THE TRANSPORT THEREOF

CROSS-REFERENCE TO RELATED APPLICATIONS

This application is claims benefit of priority from Chilean Patent Application CL 3818-2018, filed Dec. 27, 2018, the contents of which are incorporated by reference.

TECHNICAL FIELD

The present invention refers to piñatas and other container devices that store a volume of candies, gifts and/or prizes that are dispensed when the container device is opened.

BACKGROUND OF THE INVENTION

Piñatas are commonly used in celebrations; usually, in children's birthdays. They comprise a container device that is suspended in fixed high point, and that contains candies, gifts and/or prizes which are dispensed by means of some opening technique. Usually, the opening technique of the piñata consists in the breakage thereof which impedes that can be reused.

In the state of art, there are precedents that seek to resolve said problem in some manner. For example, the document U.S. Pat. No. 8,715,027 is the closest precedent to the invention since it describes an inflatable piñata that comprises an inflatable main body and a plurality of pockets coupled to said main body. Said main body includes a valve in its rear portion which allows said piñata to acquire a two-dimensional disposition when it is deflated and three-dimensional when it is inflated.

On the other hand, the document U.S. Pat. No. 4,092,798 describes a piñata formed by a cylindrical box and a lower base that complies the closing function. Said lower base has a perforation through which a thread passes which is then tied up to an inflated balloon. In this manner, by bursting the balloon, the lower base falls, releasing the content of the piñata.

Nevertheless, prior solutions of the state of the art do not adequately solve the problem of providing a piñata of reduced volume, whose transport requires little space and which at the same time is esthetically appealing.

SUMMARY OF THE INVENTION

The present invention provides a piñata of reduced volume to facilitate the transport thereof which is characterized in that comprises: an inflatable cavity; a receptacle for objects joined to said inflatable cavity, said receptacle for objects that has an aperture; a sealing means of said inflatable cavity; and means for opening and closing said aperture of said receptacle for objects.

In a preferred execution, the piñata is characterized in that it additionally comprises fastening means positioned on said inflatable cavity or on said receptacle for objects. In a more preferred execution, the piñata is characterized in that said fastening means are a pair of fins that have a separation between them. In an even more preferred execution, the piñata is characterized in that said fins are positioned on an upper portion of the piñata. In another even more preferred execution, the piñata is characterized in that each one of said fins has a perforation in their surface.

In another preferred execution, the piñata is characterized in that said sealing means of said inflatable cavity comprise a self-sealing valve.

In an additional preferred execution, the piñata is characterized in that said means for the opening and closing of said aperture of said receptacle for objects comprise a flat piece that has a through-hole. In an additional preferred execution, the piñata is characterized in that said means for the opening and closing of said aperture of said receptacle for objects comprise a flat piece that has a through-hole. In another more preferred execution, the piñata is characterized in that said receptacle for objects has a material excess in its aperture and in that said through-hole of said flat piece has a cross section that allows the insertion of said material excess.

In a preferred execution, the piñata is characterized in that said inflatable cavity is a foil balloon.

In another preferred execution, the piñata is characterized in that said inflatable cavity is arch-shaped. In a more preferred execution, the piñata is characterized in that said inflatable cavity surrounds said receptacle for objects.

DETAILED DESCRIPTION OF THE INVENTION

Figure 1:
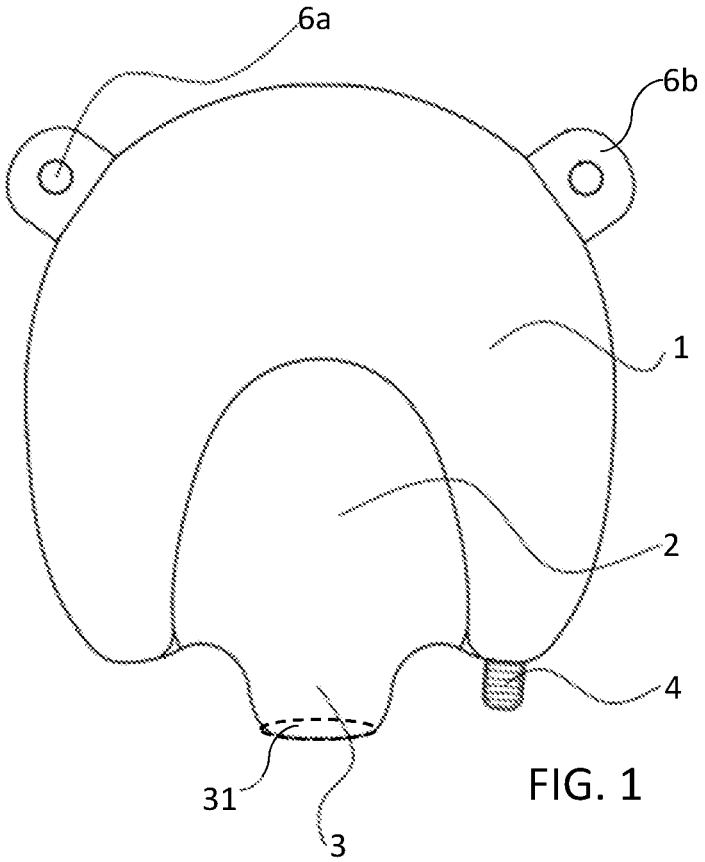
FIG. 1 shows a front view of a first execution of the piñata which is subject of the present invention.

The present invention provides a piñata of reduced volume to facilitate the transport thereof which essentially comprises an inflatable cavity (1); a receptacle for objects (2), joined to said inflatable cavity (1), said receptacle for objects that has an aperture (31); sealing means (4) of said inflatable cavity (1); and means for the opening and closing (5) of said aperture (31) of said receptacle for objects (2).

Said inflatable cavity (1) may have any shape without this limiting the scope of the present invention. For example, without this limiting the scope of the present invention, in FIG. 1 there is observed an inflatable cavity (1) that is arch-shaped and surrounds said receptacle for objects (2). However, other configurations are possible without this limiting the scope of the present invention. For example, without this limiting the scope of the present invention, said inflatable cavity (1) may have a toroidal shape and said receptacle for objects (2) may be positioned inside said toroid, as it is illustrated schematically in FIG. 2. In another preferred execution, without this limiting the scope of the present invention, said receptacle for objects (2) may have toroidal shape and said inflatable cavity (1) may be positioned inside said toroid, in an opposite way to said illustrated execution in FIG. 2.

An advantage of the present invention, without this limiting the scope thereof, is that, due to said inflatable cavity (1) may have essentially any shape, it is possible to provide a piñata of reduced volume that is esthetically appealing to a user of the same. Another advantage concerning common piñatas is that the spaced used for the storage of the piñata which is subject of the present invention is considerably reduced, as well as the loss related to its manufacturing. In addition, it allows to reuse it as piñata or simply use it as a decorative balloon after having removed the objects inside.

On the other hand, the material of said inflatable cavity (1) may be any appropriate material in order to said inflatable cavity (1) to maintain its shape once it has been inflated. For example, and without this limiting the scope of the present invention, said inflatable cavity (1) may be manufactured from an elastic and waterproof polymer, for example and without limiting to these, nylon, polyester or polypropylene. In a preferred execution, without this limiting the scope of the present invention, said inflatable cavity (1) is a foil balloon which has the advantage of being particularly visually appealing due to the metalized coating in its outer surface.

The piñata which is subject of the present invention additionally comprises sealing means (4) of said inflatable cavity (1). In the context of the present invention, it has to be understood that said inflatable cavity (1) is sealed when, substantially, there is no fluent communication between the inside of said inflatable cavity (1) and the outside of said inflatable cavity (1). Consequently, said sealing means (4) of said inflatable cavity (1) may allow the reversible or non-reversible sealing of said inflatable cavity (1) without this limiting the scope of the present invention. In this sense, without this limiting the scope of the present invention, a reversible sealing is the one which allows to recover the fluent communication between the inside of said inflatable cavity (1) and the outside thereof without functionally affecting said inflatable cavity (1), whereas a non-reversible sealing is the one in which the recovery of the fluent communication between the inside of said inflatable cavity (1) and the outside thereof affects functionally said inflatable cavity (1). A person with an average knowledge in the technical field will notice that any sealing mean known in the state of the art may be used as sealing means (4) of said inflatable cavity (1) without this limiting the scope of the present invention.

For example, and without this limiting the scope of the present invention, said sealing means (4) of said inflatable cavity (1) may comprise a self-sealing valve which avoids the exchange of fluids between the inside of said inflatable cavity (1) and the outside of it. Said self-sealing valve may be unidirectional or bidirectional without this limiting the scope of the present invention. In another example, without this limiting the scope of the present invention, said inflatable cavity (1) may possess a projection that has two walls, wherein one of them has a surface with self-adhesive characteristics, so that the sealing of said inflatable cavity (1) is obtained by sticking said walls with one another. In another additional example, without this limiting the scope of the present invention, said inflatable cavity (1) has a material excess (3) and said sealing means can be a rope or another filiform element which is knotted to said material excess (3).

Regarding said receptacle for objects (2), the same is joined to said inflatable cavity (1) and has an aperture (31).

The manner in which said receptacle for objects (2) is joined to said inflatable cavity (1) does not limit the scope of the present invention. For example, and without this limiting the scope of the present invention, said receptacle for objects (2) and said inflatable cavity (1) may be manufactured from a single piece, wherein the manufacturing process allows to define an inflatable cavity (1) and a receptacle for objects (2). However, in other preferred executions, said inflatable cavity (1) and said receptacle for objects (2) may be manufactured separately and subsequently joined. In this latter case, said joining may or may not be permanent without this limiting the scope of the present invention. For example, without this limiting the scope of the present invention, said inflatable cavity (1) may have joining means, for example a rail, and said receptacle for objects (2) have complementary joining means, such as a complementary bar to said rail.

On the other hand, regarding the aperture (31) of said receptacle for objects (2), the same allows the entry of objects inwards of said receptacle for objects (2) or the exit of objects from the inside of it. The shape and dimensions of said aperture (31) do not limit the scope of the present invention and it will depend on the objects that are to be stored inside of said receptacle for objects (2). In a preferred execution, without this limiting the scope of the present invention, said receptacle for objects (2) has a material excess (3) in said aperture (31) which may facilitate the opening and closing of the same, as it will be explained further.

Additionally, without this limiting the scope of the invention, said receptacle for objects (2) may have any shape without this limiting the scope of the present invention. A person with an average knowledge in the technical field will notice that said shape may depend on the objects that are to be stored inside said receptacle for objects. Additionally, said shape must allow the receptacle for objects (2) to have a reduced volume when it is without objects inside it.

Said receptacle for objects (2) may be manufactured with any material that allows said receptacle for objects (2) to have a reduced volume when the same is without objects inside it. Said material may be, for example and without this limiting the scope of the present invention, a flexible polymeric material, such as nylon, polyester, polypropylene or other polymers. However, other materials, such as all kind of fabrics, are equally acceptable. In a preferred execution, without this limiting the scope of the present invention, said receptacle for objects (2) is manufactured from a foil balloon which, as in the case of the inflatable cavity (1), has the advantage of being particularly visually appealing due to the metalized coating in its outer surface.

On the other hand, regarding said opening and closing means (5) of the aperture (31) of said receptacle for objects (2), the same are the ones that allow to maintain closed the aperture (31) of said receptacle for objects (2) while the objects are inside said receptacle for objects (2) and also allow its opening at the moment that it is desired to distribute said objects.

The nature of said opening and closing means (5) may be any that allows to comply with said function. For example, without this limiting the scope of the present invention, said opening and closing means (5) may be a removable lid in the aperture (31) of said receptacle for objects. In another preferred execution, without this limiting the scope of the present invention, said opening and closing means (5) may be two walls having surfaces of hook and loop kind that are complementary. In another preferred execution, without this limiting the scope of the present invention, said opening and closing means (5) may be a hermetic seal Zip/Lock type.

Figure 3:
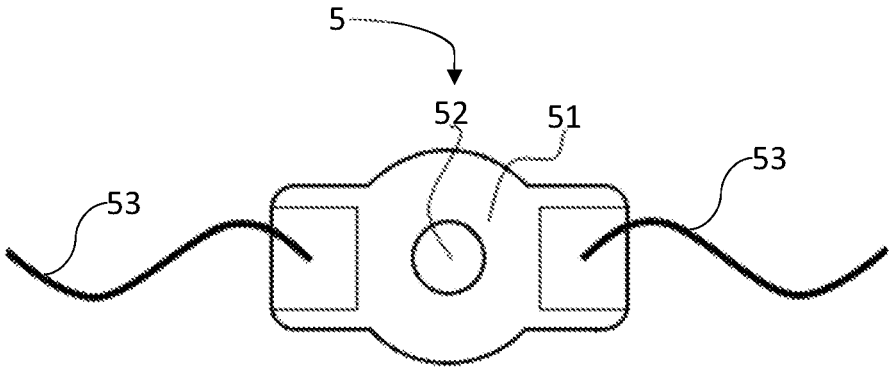
FIG. 3 shows an upper view of a first execution of the opening and closing means of the aperture of the receptacle for objects.
Figure 4:
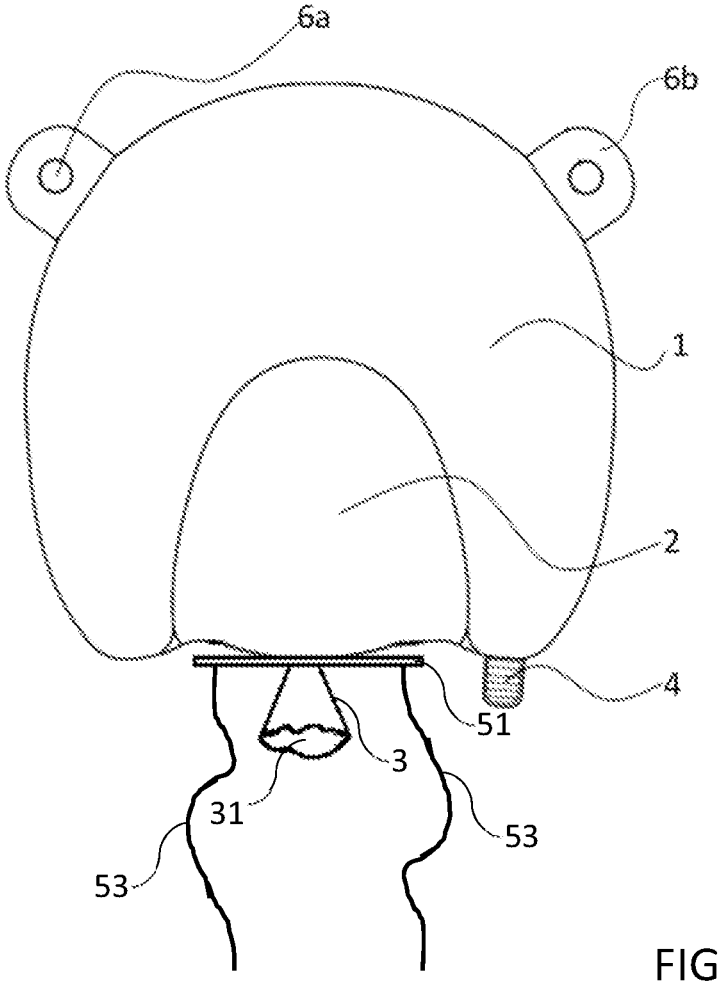
FIG. 4 shows a front view of a first execution of the piñata which is subject of the present invention when in use.

In a preferred execution, without this limiting the scope of the present invention, said opening and closing means (5) of said aperture (31) of said receptacle for objects (2) comprise a flat piece (51) that has a through-hole (52), as seen schematically in FIG. 3. The advantage of providing said flat piece (51) as a part of the opening and closing means (5) is that reduces the required space for the transport of the piñata which is the subject of the present invention. Said flat piece (51) may be rigid or flexible without this limiting the scope of the present invention and may be manufactured from any material that allows it to comply its function, such as, without limiting to these, plastics, cardboard, metal, among others. In the preferred execution in which the receptacle for objects (2) comprises a material excess (3) in its aperture (31), the through-hole (52) of said flat piece (51) may have a cross section that allows the insertion of said material excess (3) inside it, thus providing closure of said aperture (31) of said receptacle for objects (2). In another preferred execution, said means for opening and closing (5) the aperture (31) of said receptacle for objects (2) additionally comprise a filiform element (53) functionally coupled to said flat piece (51). Said filiform element (53), if provided, when it is pulled forcefully, allows to slide said flat piece (51) along the aperture (31) of said receptacle for objects (2), obtaining in this manner the opening of said aperture (31).

In the context of the present invention a filiform element (53) must be understood as an element that have properties similar to a thread and that may be, without limiting to these, a cable, a rope, a thread, a ribbon or another element having characteristics similar to the ones previously mentioned. In a preferred execution, and without this limiting the scope of the present invention, said filiform element (53) is a ribbon.

Additionally, it should be understood that the manner in which said filiform element (53) is functionally coupled to said flat piece (51) does not limit the scope of the present invention.

For example, and without this limiting the scope of the present invention, said flat piece (51) may comprise a plurality of through-holes (not illustrated in the figures) in which said filiform element is inserted (53), functionally coupling it to said flat piece (51). In another example, without this limiting the scope of the present invention, said filiform element (53) may stick to one or both surfaces of said flat piece (51). In a third example, without this limiting the scope of the present invention, said filiform element (53) may be knotted to a portion of said flat piece (51).

In a preferred execution, without this limiting the scope of the present invention, the piñata which is subject of the present invention additionally comprises fastening means (6) positioned on said inflatable cavity (1) or on said receptacle for objects (2). Said fastening means (6) allow the piñata which is subject of the present invention to be hung, without this limiting the scope thereof. Consequently, said fastening means (6) may be of any kind known in the state of the art without this limiting the scope of the present invention.

Figure 2:
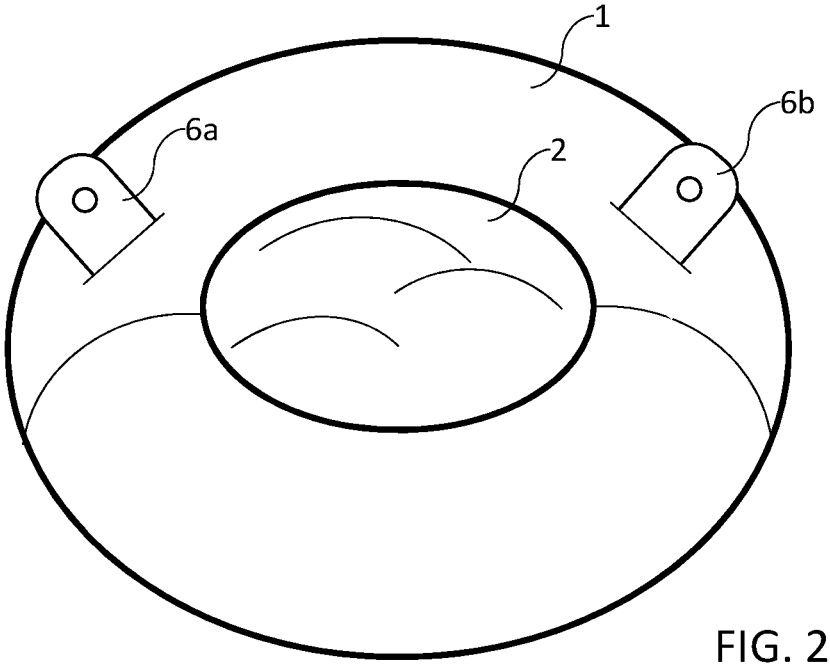
FIG. 2 shows a front view of a second execution of the piñata which is subject of the present invention.

In a preferred execution, without this limiting the scope of the present invention and as it is illustrated schematically in FIGS. 1 and 2, said fastening means (6) are a pair of fins (6*a*, 6*b*) having a gap between them. However, a person with average knowledge in the technical field could provide a single fin, or more than two fins as fastening means (6) without this limiting the scope of the present invention.

In a more preferred execution, said fins (6*a*, 6*b*) are positioned on an upper portion of the piñata, however, a person with average knowledge in the technical field will notice that said fins (6*a*, 6*b*) may be positioned on other portions of the piñata without this limiting the scope of the present invention. For example, without this limiting the scope of the present invention, said fins (6*a*, 6*b*) may be positioned on a lateral portion of the piñata which is subject of the present invention.

In another more preferred execution, said fins (6*a*, 6*b*) have a perforation in their surface. Said perforation allows the coupling, for example and without this limiting the scope of the present invention, of a rope that allows the fastening of the piñata which is subject of the present invention.

According to the previously detailed description it is possible to obtain a piñata of reduced volume to facilitate the transport thereof. Additionally, the piñata which is subject of the present invention has the advantage of being esthetically appealing to a user.

Hereinafter, examples of the execution of the piñata which is subject of the present invention will be presented. It should be understood that said examples are presented with an illustrative objective but do not limit the scope of the requested protection. Additionally, technical aspects detailed in different examples may be combined with each other or with other aspects of the detailed description without this limiting the scope of the present invention.

Example 1: Manufacturing of a Reduced Volume Piñata

A piñata was manufactured according to the present invention using for this purpose two rolls of polymeric material, which have printed a previously established design.

Said rolls of polymeric material were assembled in a converting machine, one roll for each face of the piñata that was manufactured. Additionally, a self-sealing valve was inserted between each pair of faces of the piñata.

Once that both layers of material were in the right position, and with the self-sealing valve in the corresponding place, the converting machine joined both layers, defining in it the receptacle for objects. Said receptacle for objects included an aperture that has a material excess.

Subsequently, the converting machine defined the inflatable cavity by the means of the outer joining of both layers of material, as well as a pair of fins positioned on the upper portion of said inflatable cavity, proceeding, subsequently to the cutting of the material.

The invention claimed is:

1. A piñata of reduced volume to facilitate the transport thereof, comprising:

an inflatable cavity;

a receptacle for objects, joined to said inflatable cavity, said receptacle for objects possesses a material excess having an aperture facing down;

a sealing means for said inflatable cavity; and means for opening and closing said aperture of said receptacle for objects, wherein said means for opening and closing said aperture comprises a flat piece having a through-hole, wherein said through-hole of said flat piece has a cross section that allows the insertion of said material excess in such a way that said flat piece can slide along the material excess wherein said means for opening and closing said aperture of said receptacle for objects additionally comprises a filiform element functionally coupled to said flat piece, wherein when said filiform element is forcefully pulled said flat piece slides along said material excess to open said aperture and release said objects.

2. The piñata according to claim 1, additionally comprising fastening means positioned on said inflatable cavity or on said receptacle for objects.

3. The piñata according to claim 2, wherein said fastening means are a pair of fins that have a gap between them.

4. The piñata according to claim 3, wherein said fins are positioned on an upper portion of the piñata.

5. The piñata according to claim 3, wherein each one of said fins has a perforation on their surface.

6. The piñata according to claim 1, wherein said sealing means of said inflatable cavity comprises a self-sealing valve.

7. The piñata according to claim 1, wherein said inflatable cavity is a foil balloon.

8. The piñata according to claim 1, wherein said inflatable cavity is arch-shaped.

9. The piñata according to claim 8, wherein said inflatable cavity is arch-shaped and surrounds said receptacle for objects.

* * * * *